US007971284B2

(12) United States Patent
Pessel et al.

(10) Patent No.: US 7,971,284 B2
(45) Date of Patent: Jul. 5, 2011

(54) FLUSHING WATER GUIDING ARRANGEMENT FOR A TOILET BOWL

(75) Inventors: Frank Pessel, Duesseldorf (DE); Arndt Scheidgen, Essen (DE); Hans-Georg Muehlhausen, Duesseldorf (DE); Ralph Butter-Jentsch, Langenfield (DE)

(73) Assignee: Henkel KGaA, Düsseldorf (DE)

( * ) Notice: Subject to any disclaimer, the term of this patent is extended or adjusted under 35 U.S.C. 154(b) by 866 days.

(21) Appl. No.: 11/993,070

(22) PCT Filed: Mar. 24, 2006

(86) PCT No.: PCT/EP2006/002706

§ 371 (c)(1),
(2), (4) Date: Dec. 19, 2007

(87) PCT Pub. No.: WO2006/136215

PCT Pub. Date: Dec. 28, 2006

(65) Prior Publication Data

US 2009/0293187 A1 Dec. 3, 2009

(30) Foreign Application Priority Data

Jun. 23, 2005 (DE) ..... 10 2005 029 609

(51) Int. Cl.
*E03D 9/02* (2006.01)

(52) U.S. Cl. ..... 4/232

(58) Field of Classification Search ..... 4/231, 232, 4/226.1, 222, 223, 224, 228.1
See application file for complete search history.

(56) References Cited

U.S. PATENT DOCUMENTS

| | | | | |
|---|---|---|---|---|
| 149,195 | A | 3/1874 | Burns et al. | |
| 913,355 | A * | 2/1909 | Butler | 4/232 |
| 1,178,852 | A * | 4/1916 | Grant | 4/232 |
| 1,211,137 | A * | 1/1917 | Grant | 4/421 |
| 1,234,624 | A * | 7/1917 | Carroll | 4/232 |
| 1,419,498 | A * | 6/1922 | Grant | 4/232 |
| 1,592,101 | A * | 7/1926 | Grant | 4/232 |
| 2,034,619 | A * | 3/1936 | Hoffman | 4/231 |
| 2,991,517 | A * | 7/1961 | Bundy | 422/123 |
| 4,873,727 | A * | 10/1989 | Homan | 4/226.1 |
| 4,912,784 | A * | 4/1990 | Jacobson et al. | 4/300.3 |
| 2004/0068782 | A1 * | 4/2004 | Butter-Jentsch et al. | 4/231 |
| 2004/0107484 | A1 * | 6/2004 | Butter-Jentsch et al. | 4/231 |
| 2004/0221378 | A1 * | 11/2004 | Conway et al. | 4/231 |

FOREIGN PATENT DOCUMENTS

| | | |
|---|---|---|
| BE | 789895 | 2/1973 |
| DE | 1658261 | 3/1972 |
| EP | 0 643 177 B1 | 3/1995 |
| EP | 1 001 097 B1 | 5/2000 |

* cited by examiner

*Primary Examiner* — David Purol
(74) *Attorney, Agent, or Firm* — Connolly Bove Lodge & Hutz LLP

(57) ABSTRACT

The invention relates to a flushing water guiding arrangement (1) for a toilet bowl (5) or similar, comprising a housing which can be inserted into the edge (4) of the toilet bowl, an inlet (6), at least one outlet (7, 8, 10) and a dispensing device (11) which is used to dispense at least one liquid active substance as a supplement to the flushing water. The dispensing device (11) comprises at least one container (12) which is used to receive the active substance and at least one dispensing opening (13) which is arranged between the inlet (6) and the outlet (J, 8, 10). The flushing water guiding arrangement is characterized in that low pressure is set in the container (12) when the active substance is dispensed and that, essentially, only air reaches into the container (12) which is suctioned by the low pressure in the container (12).

26 Claims, 6 Drawing Sheets

FLUSHING WATER GUIDING ARRANGEMENT FOR A TOILET BOWL

RELATED APPLICATIONS

Figure 1:
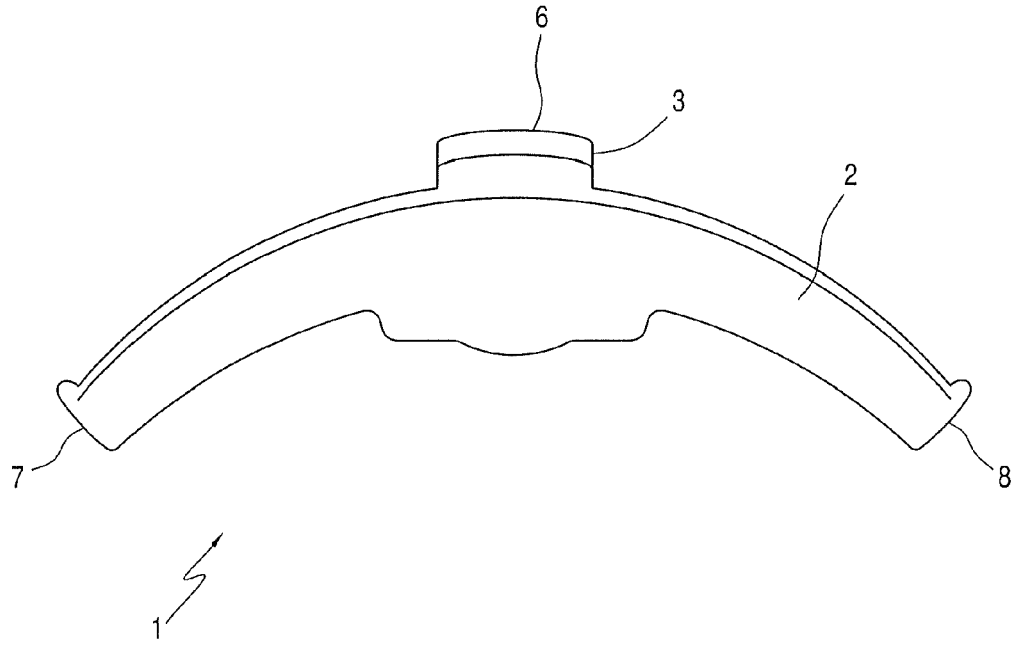

This application is a national stage application (under 35 U.S.C. 371) of PCT/EP2006/002706 filed Mar. 24, 2006, which claims benefit of German application 10 2005 029 609.2 filed Jun. 23, 2005.

The invention relates to a flushing water guiding arrangement for a toilet bowl, urinal bowls or the like.

A flushing water guiding arrangement with a plastic housing is known from DE 198 51 754 C2 and can be inserted into an edge of the toilet bowl. Here, the flushing water guiding arrangement provides a specific guide for the flushing water in the toilet bowl in order to supply the bowl with flushing water in a desired way.

The flushing water guiding arrangement known from DE 198 51 754 C2 possesses an inlet and a plurality of outlets for the flushing water. Moreover, the flushing water guiding arrangement includes a dispensing device for dispensing at least one liquid active substance as a supplement to the flushing water. A container of the dispensing device receives the active substance and possesses an inlet opening and a plurality of dispensing openings. In the course of a flushing cycle, flushing water then flows through the inlet into the flushing water guiding arrangement and a part of the flushing water reaches the container through the inlet opening, is mixed there with the active substance, and escapes again through the dispensing openings out of the container. According to DE 198 51 754 C2 the active substance is intended to be dispensed by calibrating the inlet opening as a function of the viscosity of the active substance.

With time, the active substance becomes more and more diluted by the mixing processes that take place in the container, with the result that its product properties are changed. This makes a controlled and measured dispensing of the active substance difficult. In addition, it is difficult to recognize when the active substance is used up because there is always a mixture of flushing water and active substance in the container, the proportions of the mixture being unknown.

Accordingly, the invention is based on the object of further developing a flushing water guiding arrangement such that it is possible to dispense the active substance in a controlled and measured way.

The object on which the invention is based is achieved by means of a flushing water guiding arrangement according to claim 1. Preferred embodiments of the inventive flushing water guiding arrangement can be found in the dependent claims.

The inventive flushing water guiding arrangement is characterized in that a reduced pressure is set up while the active substance is being dispensed in the container and that essentially only air passes into the container by being sucked in due to the reduced pressure in the container. Consequently, mixing of flushing water and active substance does not occur in the container. This in turn means that the product properties, especially the viscosity of the active substance, do not change with time, and consequently it is possible to dispense the active substance in a controlled and measured way.

As the active substance is dispensed, the volume taken up by the active substance in the container is reduced. With a constant or approximately constant volume of the container, this leads to a reduced pressure. The reduced pressure acts against the active substance being dispensed or influences the dispensed amount. If the reduced pressure falls below a defined threshold and/or circumstances occur that promote an ingress of air into the container, then air is sucked into the container.

In a preferred embodiment, the air is sucked in through the dispensing opening and/or through at least one opening located close to the dispensing opening, wherein means are provided, which prevent any ingress of flushing water into the container. As the dispensing opening is located between the inlet and outlet of the flushing water, i.e. as seen in the direction of the main flow, behind the inlet and before the outlet, there exists a danger that during ingress into the flushing water guiding arrangement, the flushing water is in contact with the dispensing opening and in the case of a suitable reduced pressure in the container will be sucked in instead of the required air. However, this must be avoided as otherwise there is the danger that the active substance in the container will be diluted.

Preferably, the dispensing opening of the dispensing device is located close to the inlet. This type of design ensures that not only a partial flow of the flushing water is mixed with the active substance, but also the maximum possible of the total flushing water can be mixed with the active substance. In this way, one ensures that not only part of the toilet bowl is wetted, but also the maximum possible of the whole toilet bowl.

Plastic is a preferred material for the housing. In this way practically no limits are placed by the suitable processes (e.g. injection molding, blow molding) for molding the housing. Accordingly, the flow ratios in the flushing water guiding arrangement can be arbitrarily adjusted, without having to adapt the shape of the toilet bowls that are normally made of ceramics to the required flow ratios.

In a preferred embodiment, the housing possesses a connecting piece for a flushing water supply and two end openings that tangentially discharge into the edge of the bowl. Thus, when installed, the connection piece is located in a rearmost part of the toilet bowl. The flushing water is guided into a front part of the toilet bowl through the two tangentially discharging end openings.

A plurality of openings can be provided on the underside of the housing. These openings underneath ensure that the rearmost part of the toilet bowl is also supplied with flushing water.

When the flushing water guiding arrangement is installed, the dispensing opening of the dispensing device is preferably directed downwards. Consequently, due to gravity, the active substance in the container always rests against the dispensing opening. Air that is sucked in by the reduced pressure in the container is therefore collected in an upper part of the container.

In a preferred embodiment, the dispensing opening faces a plate-like element, whereby due to the product properties of the active substance, in particular the viscosity, and due to the reduced pressure in the container, essentially no active substance is discharged through the dispensing opening. This should be regarded as a rest position, in which no flushing water flows through the inlet into the flushing water guiding arrangement. Thus, an outlet opening is formed between the dispensing opening and the plate-like element, said outlet having a cross sectional flow with dimensions such that without the action of flushing water, the active substance will not egress the container. If flushing water flows around the space between the dispensing opening and the plate-like element, then the active substance close to the dispensing opening is diluted or flushed away by the flushing water, such that the active substance is dispensed.

One of the tube sections that forms the dispensing opening is connected with the plate-like element in a surrounding area facing the inlet for flushing water This leads to an outlet opening in the form of an annular segment, wherein this annular gap faces away from the flushing water inlet and therefore the main direction of flow. The connection between the tube section and the plate-like element thus prevents the flushing water from easily contacting the available active substance in the dispensing opening. Firstly, this is intended to prevent too much active substance being delivered during a flush cycle. Secondly, it is intended to preclude any ingress of flushing water into the container.

The means to prevent the ingress of flushing water into the container can include guide walls, flow resistances, deflectors or the like. These guide walls or deflectors can be advantageously fixed on the plate-like element. They can be integrally molded to the element.

When installed, the dispensing opening and the plate-like element are preferably located in an upper region of the housing. This reduces the danger of the dispensing opening remaining under water for a long period during a flush cycle, which would allow flushing water to enter the container.

The flushing water guiding arrangement can include a container for receiving an additional active substance in solid form. For example, a cage for a chlorine tablet can be provided, which is located between the inlet and outlet of the flushing water guiding arrangement. During a flush cycle, the chlorine tablet is flushed with flushing water and consequently dispenses its active substances.

Alternatively or in addition, a container for receiving a fragrance carrier can be provided, wherein the fragrance carrier preferably does not come into contact with the flushing water. In this way the flushing water guiding arrangement not only provides for a measured dispensation of liquid active substance that is mixed with the flushing water, but also for dispensing a fragrance into the air of the room, in which the toilet bowl is located. The carrier can preferably include a plurality of plastic pellets, in which the fragrance is incorporated. However, the fragrance can also be dispensed by means of a gel or a liquid.

The fragrance carrier can be separated from the surroundings by means of a semi-permeable membrane or separating wall. The separating wall thus prevents the carrier from coming into contact with the flushing water, but allows a passage for the released fragrance.

The container for the liquid active substance is preferably exchangeable. When the liquid active substance is used up, then the empty container can be easily replaced by a full container. Moreover, in the same way the container for receiving a solid active substance and/or the container for receiving a fragrance carrier can also be exchangeable.

The container for the liquid active substance can also be refillable. In this way an exchange of the container is not necessary, rather when needed, the container can be refilled through an inlet opening that is provided.

The container can include a plurality of containers for receiving a plurality of liquid active substances that are separated from each other. In this way a plurality of active substance components can be introduced into the flushing water, which are not storage stable when stored together.

Furthermore, the invention proposes a toilet bowl with an oval or round bowl edge, wherein the bowl edge possesses a recess, into which the container of the dispensing device of the inventive flushing water guiding arrangement can be at least partially inserted. In a preferred embodiment of the toilet bowl, the recess is designed such that the container is flush with the bowl edge.

The flushing water guiding arrangement can also possess a means for enabling a controlled residual release or a controlled "delayed dripping" after the recent flush cycle. For example, the means can include a siphon that overflows once a defined liquid level is reached, thus releasing the quantity of liquid present in the siphon. This delayed dripping can be made visible by a suitable dyeing of this quantity of liquid.

The invention is described in more detail with reference to an example of an embodiment illustrated in the figures. The drawings show:

FIG. 1 a housing of a flushing water guiding arrangement

Figure 2:
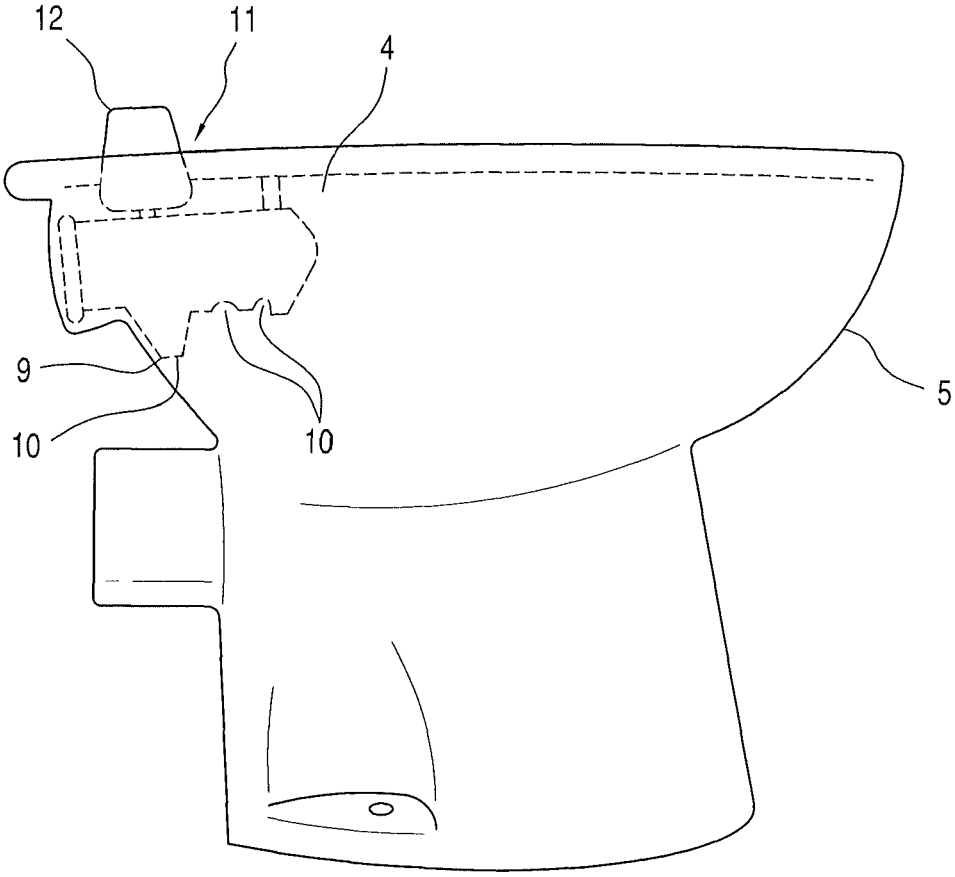

FIG. 2 a toilet bowl with the inserted flushing water guiding arrangement

Figure 3:
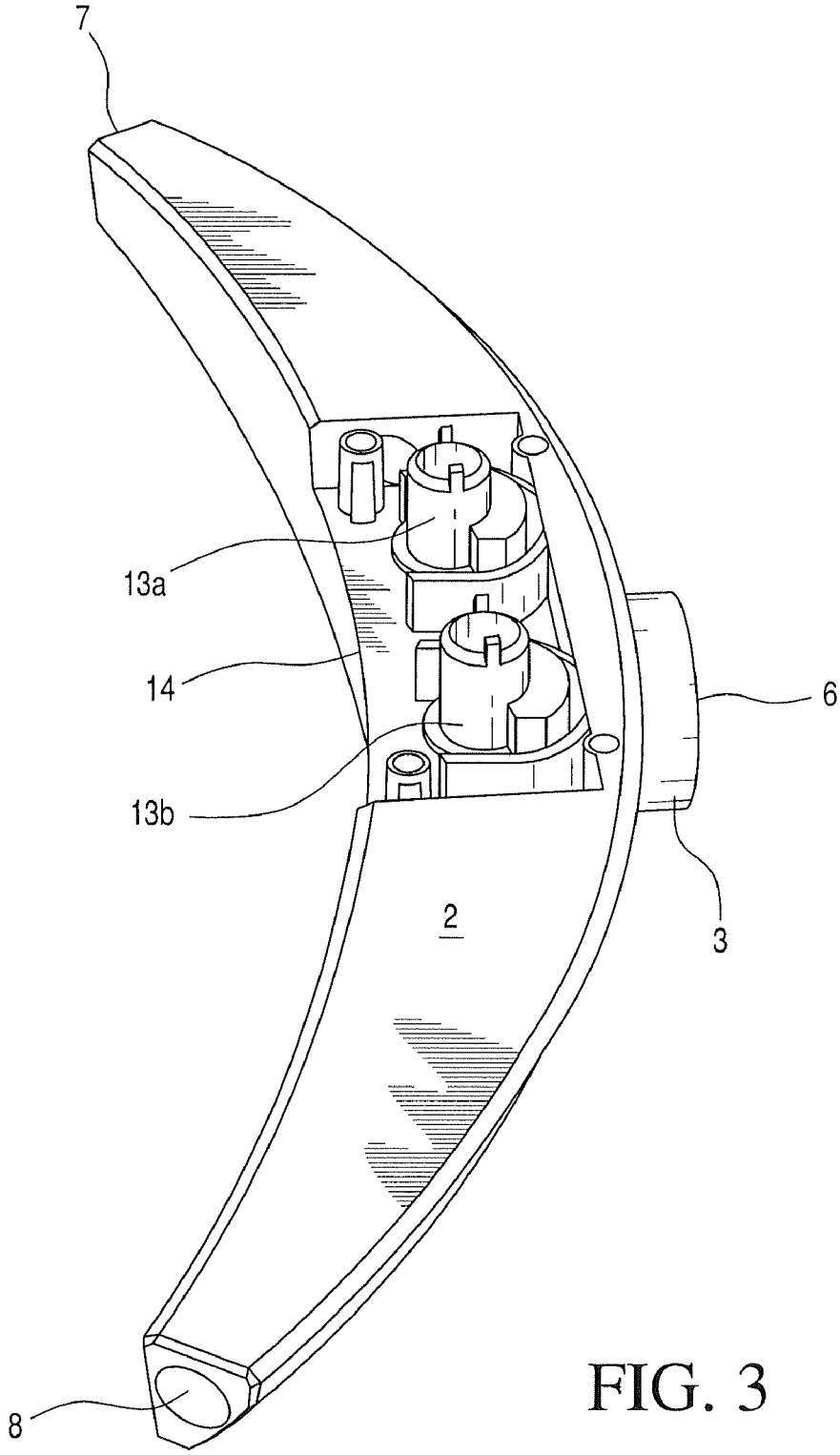
Figure 4:
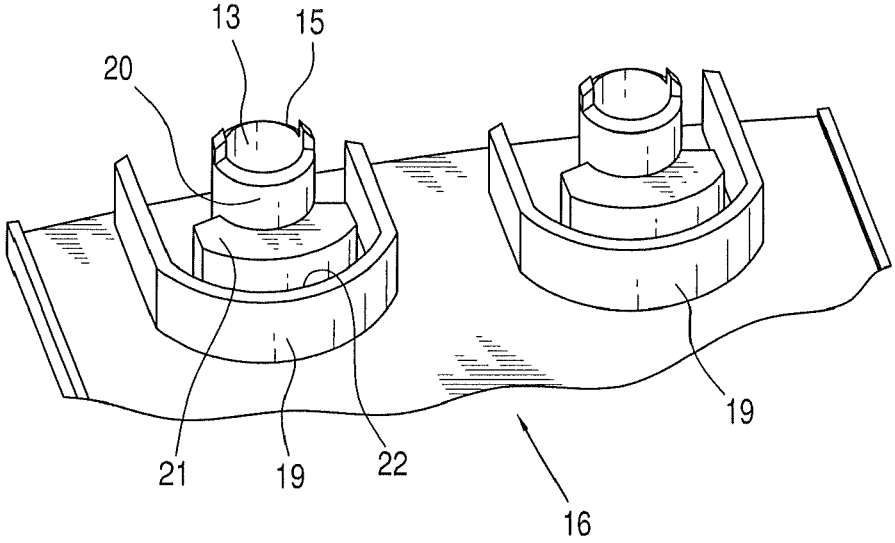

FIG. 3 a perspective view of the flushing water guiding arrangement;

FIG. 4 a dispensing device of the flushing water guiding arrangement

Figure 5:
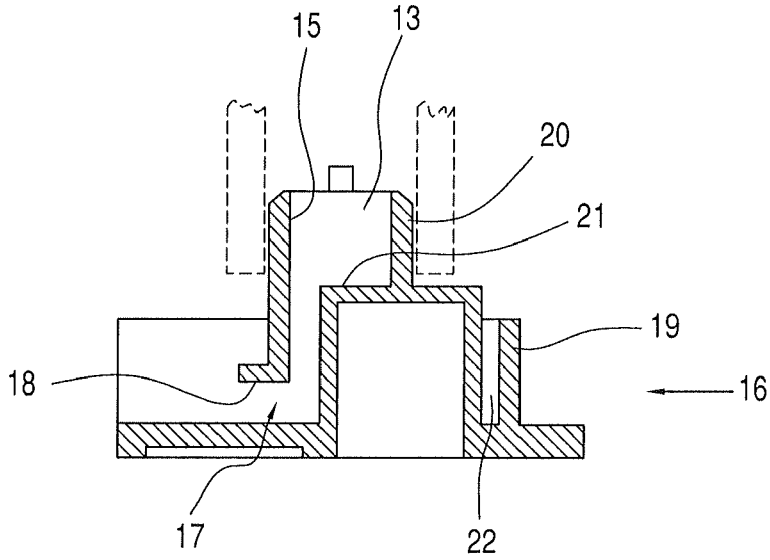
Figure 6:
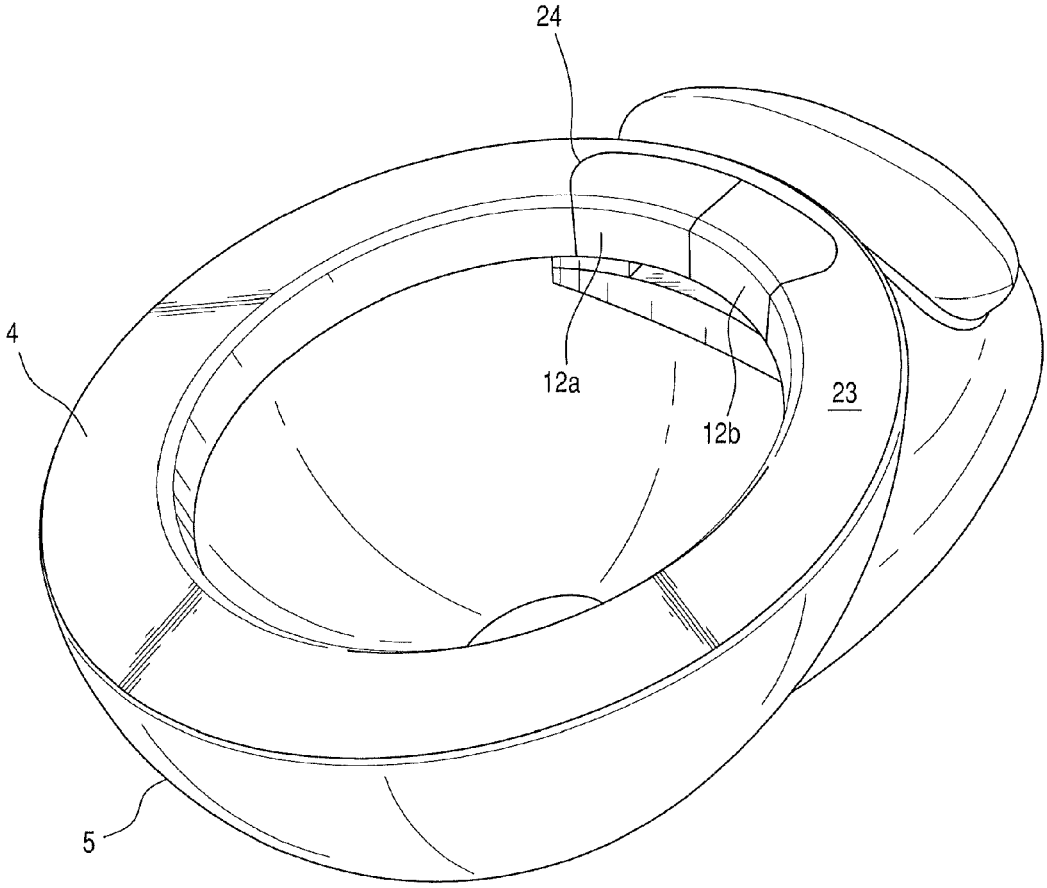

FIG. 5 A cross section of the dispensing device of FIG. 4;

FIG. 6 a further toilet bowl, and

Figure 7:
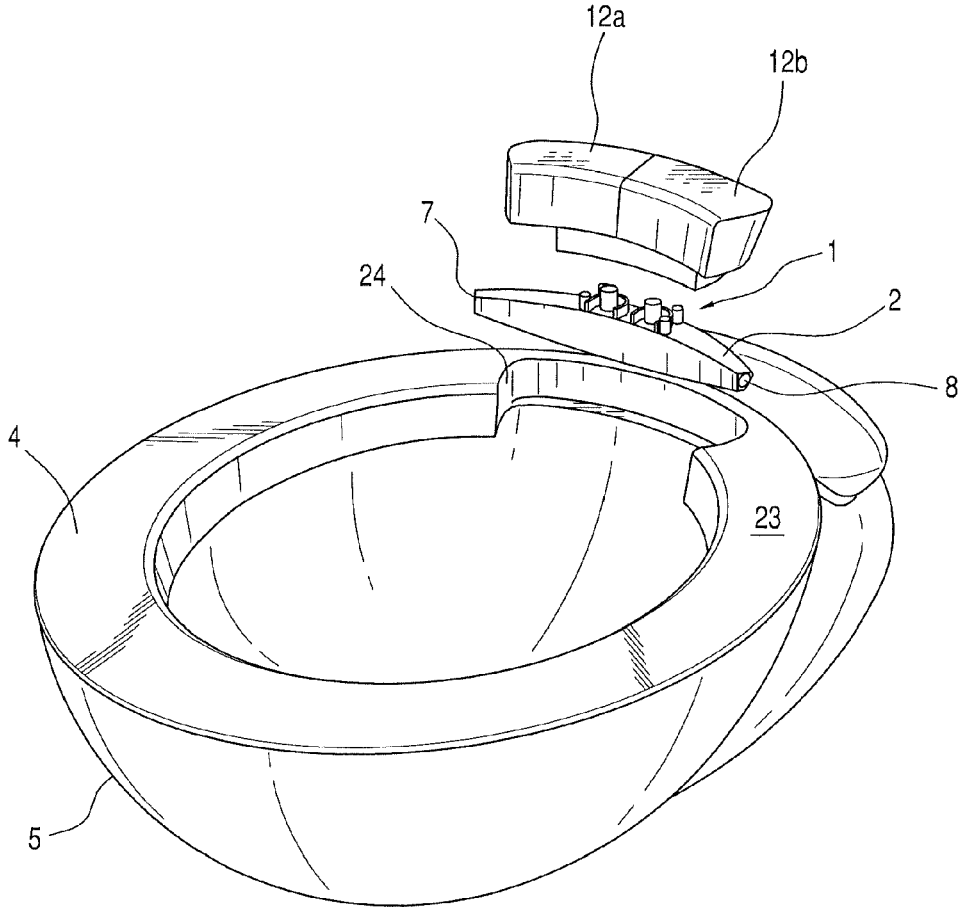

FIG. 7 an exploded view of a toilet bowl similar to that of FIG. 6.

FIG. 1 shows a flushing water guiding arrangement, marked with the reference numeral 1. It possesses a plastic housing 2 that is provided with a connecting piece 3 for a supply of flushing water. As indicated in FIG. 2, the flushing water guiding arrangement 1 can be inserted into a bowl edge 4 of a toilet bowl 5. Because the housing is fitted into the bowl edge 4 of the toilet bowl 5. it has a curved basic shape.

An inlet 6 for flushing water is provided by the connecting piece 3, through which the toilet bowl 5 can be cleaned or rinsed. During a flush cycle the flushing water entering through the inlet 6 is essentially divided into two main flows that flow tangentially through end openings 7, 8 into the bowl edge 4. Furthermore, the housing 2 possesses additional outlet openings 10 on an under side 9. In this way the flushing water entering the housing 2 goes out through a plurality of openings in order to achieve a required distribution of the flushing water in the toilet bowl.

In FIG. 2 and 3 a dispensing device 11 or part of it can be recognized, through which a liquid active substance can be admixed in the flushing water entering the flushing water guiding arrangement 1 (not shown in FIG. 1). The dispensing device 11 possesses a container 12 that includes two receptacles 12*a*, 12*b* that are separated from one another (see FIG. 6 and 7, not shown in FIG. 3). The receptacles 12*a*, 12*b* are each connected with a dispensing opening 13*a* and 13*b* respectively, through which the active substance present in the receptacles 12*a*, 12*b* can leave the housing 2. Part of the housing 2 is not illustrated in half of the schema as it would mask the dispensing device 11 in the Figures.

The dispensing openings 13*a*, 13*b* are located close to the inlet 6 or as seen from the main flow direction of the flushing water, between inlet 6 and the discharge openings 7, 8, 10. This configuration is intended to allow the active substance from the receptacles 12*a*, 12*b* to be mixed with the greatest possible flushing water, such that a mixture of flushing water and active substance leaves from all openings 7, 8, 10.

The dispensing device 11 possesses a plate-like element 14 that when installed lies in a horizontal plane and extends into the housing. This plate-like element 14 is also illustrated in FIG. 4. The receptacles 12*a*, 12*b* can each be positioned on a socket or on a tube section 15. The arrow in FIG. 4 shows from which direction the flushing water entering through the inlet 6 mainly meets the dispensing device 11.

In the following description of the plate-like element 14, the tube section 15 as well as the part molded on the plate-like element 14, reference is also made to FIG. 5, which shows the dispensing device 11 (without receptacles 12*a*, 12*b*) in cross section. No differentiation will be made in the following between the receptacles 12*a*, 12*b* and the components that each cooperate with a receptacle.

In a rest position, i.e. without the action of flushing water, the dispensing opening 13 with the receptacle 12 located beyond it is filled with active substance. Due to the viscosity and also the surface tension of the active substance and to the reduced pressure that prevails in the receptacle 12, the active substance does not flow though a lateral outlet opening 17, but rather forms a "meniscus" that is formed between a lower edge 18 of the tube section 15 and an upper side of the plate-like element 14. If flushing water now enters through the inlet 6 into the housing 2, then it flows in the direction of the arrow 16 against a deflector 19. As can be seen in FIG. 4, the deflector is somewhat U-shaped and protects the lateral outlet opening 17 (see FIG. 5) from a direct admission of flushing water. A support 21 is molded on the tube section 15 on the side 20 of the tube section that faces the inlet 6, onto which support the container 12 (not shown in FIGS. 4 and 5) is seated in the assembled position. Deflector 19 and support 21 form a sickle-like channel 22, through which the flushing water reaches the region of the outlet opening 17. The meniscus of the active substance, which is formed there, is washed away or carried off by the flushing water, such that the active substance is dispensed. In this way active substance continues to flow through the dispensing opening 13 and forms, in so far as no flushing water is present in the region of the lateral outlet opening 16, a new meniscus.

Because the active substance has been dispensed and due to the resulting associated increase in reduced pressure in the receptacle 12, air is sucked into the receptacle 12. In the cycle, the air is primarily sucked in, in the phase during which the meniscus is washed away by the flushing water. Accordingly, the dispensing device 11 is constructed such that only air and no flushing water is sucked into the receptacle through the dispensing opening 13.

Finally, FIGS. 6 and 7 show further embodiments tor a toilet bowl 5 with a bowl edge 4 that possesses a recess 24 for receiving two receptacles 12*a*, 12*b* in a rearmost sector 23. The receptacles 12*a*, 12*b* and the recess 24 are formed such that the receptacles 12*a*, 12*b* lie flush with the bowl edge 4 and form an esthetically appealing unit.

In the context of the invention, the receptacles 12*a*, 12*b* may of course also be located outside the toilet bowl 5. For example, the receptacles 12*a*, 12*b* can also be located in a toilet tank, wherein they are connected by pipes with the tube sections 15.

LIST OF REFERENCE NUMERALS

1 Flushing water guiding arrangement
2 Housing
3 Connecting piece
4 Bowl edge
5 Toilet bowl
6 Inlet
7 End opening
8 End opening
9 Lower side
10 Opening
11 Dispensing device
12 Container (12*a*, 12*b* receptacles)
13 Dispensing opening
14 Plate-like element
15 Support/tube section
16 Arrow
17 Outlet opening
18 Lower edge
19 Deflector
20 Side
21 Support
22 Channel
23 Rearmost region
24 Recess

The invention claimed is:

1. A flushing water guide for a toilet bowl or urinal, comprising:

a housing defining an inlet adapted to receive flushing water and at least one outlet adapted to release the flushing water mixed with at least one liquid additive dispensed into the flushing water;

a dispensing device held within said housing and adapted for dispensing the at least one liquid additive into the flushing water, said dispensing device comprising at least one container disposed for receiving the liquid additive said dispensing device further comprising a plate from which extends (a) at least one upstanding arcuate deflector having a convexly curved face directed toward the inlet, and (b) a tube section spaced apart from the deflector and away from the inlet, said tube section defining a dispensing opening adapted for the liquid additive to flow out of the container and onto the plate.

2. The flushing water guide of claim 1, wherein the housing further defines a second outlet adapted to release the flushing water mixed with the at least one liquid additive.

3. The flushing water guide of claim 2, wherein the at least one outlet is at a first end of the housing and the second outlet is at an opposite end of the housing.

4. The flushing water guide of claim 3, wherein the housing further defines one or more additional outlets through an underside of the housing.

5. The flushing water guide of claim 1, wherein the plate lies in a horizontal plane in an upper region of the housing.

6. The flushing water guide of claim 1, wherein the tube section is in an annular gap defined by the deflector.

7. The flushing water guide of claim 1, wherein the plate lies in a horizontal plane.

8. The flushing water guide of claim 1, further comprising a support in contact with the tube section in the dispensing opening.

9. The flushing water guide of claim 8, wherein the support is molded on the tube section.

10. The flushing water guide of claim 1, wherein the tube section defines a lateral outlet opening at a lower portion of the tube section, said lateral outlet opening directed away from the convexly curved face of the deflector.

11. The flushing water guide of claim 10, wherein the lateral outlet opening is adapted to direct liquid additive onto the plate.

12. The flushing water guide of claim 11, wherein the lateral outlet opening communicates with an annular gap defined by deflector and the plate.

13. The flushing water guide of claim 8, wherein the container is seated on the support.

14. The flushing water guide of claim 1, further comprising a second container for receiving a fragrance carrier disposed in the dispensing device.

15. A toilet bowl with a flushing water guiding arrangement, comprising:

a toilet bowl with an oval or round bowl edge;

a housing joined to or seated on the bowl edge, said housing defining an inlet adapted to receive flushing water and at least one outlet adapted to release the flushing water mixed with at least one liquid additive dispensed into the flushing water into the bowl;

a dispensing device held within said housing and adapted for dispensing the liquid additive into the flushing water, said dispensing device comprising at least one container disposed therein for receiving the liquid additive, said dispensing device further comprising a plate from which extends (a) at least an upstanding arcuate deflector having a U-shaped face directed toward the inlet, and (b) a tube section spaced apart from the deflector and away from the inlet in a region between legs of the U-shaped deflector, said tube section defining a dispensing opening adapted for the liquid additive to flow out of the container and onto the plate.

16. The toilet bowl of claim 15, wherein the bowl edge defines a recess for at least partially receiving the housing.

17. The toilet bowl of claim 15, wherein the housing further defines a second outlet adapted to release the flushing water mixed with the at least one liquid additive.

18. The toilet bowl of claim 17, wherein the at least one outlet is at a first end of the housing and the second outlet is at an opposite end of the housing.

19. The toilet bowl of claim 18, wherein the housing further defines one or more additional outlets through an underside of the housing.

20. The toilet bowl of claim 15, wherein the plate lies in a horizontal plane in an upper region of the housing.

21. The toilet bowl of claim 15, wherein the tube section is in an annular gap defined by the deflector.

22. The toilet bowl of claim 15, further comprising a support in contact with the tube section in the dispensing opening.

23. The toilet bowl of claim 15, wherein the support is molded on the tube section.

24. The toilet bowl of claim 15, wherein the tube section defines a lateral outlet opening at a lower portion of the tube section, said lateral outlet opening directed away from the convexly curved face of the deflector.

25. The toilet bowl of claim 15, wherein the lateral outlet opening communicates with an annular gap defined by deflector and the plate.

26. The toilet bowl of claim 15, further comprising a second container for receiving a fragrance carrier disposed in the dispensing device.

* * * * *